US010934697B2

(12) United States Patent
Spiller

(10) Patent No.: US 10,934,697 B2
(45) Date of Patent: Mar. 2, 2021

(54) BACKFLOW ASSEMBLY AND ATTACHMENTS

(71) Applicant: Paul Spiller, Elgin, IL (US)

(72) Inventor: Paul Spiller, Elgin, IL (US)

( * ) Notice: Subject to any disclaimer, the term of this patent is extended or adjusted under 35 U.S.C. 154(b) by 0 days.

(21) Appl. No.: 16/440,621

(22) Filed: Jun. 13, 2019

(65) Prior Publication Data

US 2020/0392708 A1 Dec. 17, 2020

(51) Int. Cl.
*E03B 7/07* (2006.01)
*E03C 1/10* (2006.01)

(52) U.S. Cl.
CPC ..... *E03C 1/106* (2013.01); *E03B 7/077* (2013.01); *Y10T 137/4245* (2015.04)

(58) Field of Classification Search
CPC . E03C 1/10; E03C 1/106; E03B 7/077; Y10T 137/4245
USPC ..... 137/613, 240; 222/148, 149
See application file for complete search history.

(56) References Cited

U.S. PATENT DOCUMENTS 6,820,635 B1 * 11/2004 McKeague ..... E03B 9/04 134/166 C
10,006,456 B2 * 6/2018 Bazan ..... F04B 53/04
2010/0212751 A1 * 8/2010 Noll et al. ..... B08B 9/027 137/15.04
2012/0211091 A1 * 8/2012 Carter et al. ..... B63B 13/00 137/15.04
2015/0300548 A1 * 10/2015 Korte et al. ..... F16L 21/005 137/15.14
2017/0336380 A1 * 11/2017 McKeague et al. ..... E03B 7/07

* cited by examiner

*Primary Examiner* — Kevin L Lee
(74) *Attorney, Agent, or Firm* — Charles F. Meroni, Jr.; Meroni & Meroni, P.C.

(57) ABSTRACT

An improved backflow assembly apparatus is contemplated. The apparatus having a backflow assembly, the backflow assembly having a body, an inlet, a first valve control assembly connecting the inlet to the body, an outlet, and a second valve control assembly connecting the outlet to the body, and a flushing system connected to the body of the backflow assembly, the flushing system having an access lid for connecting directly to the body, a relief valve connected to the access lid, and a flushing hose attached to the relief valve.

17 Claims, 2 Drawing Sheets

BACKFLOW ASSEMBLY AND ATTACHMENTS

FIELD OF THE INVENTION

The present invention generally relates to backflow assemblies and improved attachments. The assembly is installed to prevent backflow and backpressure of contaminated materials into the potable water supply, and allows the draining thereof.

BACKGROUND

Plumbing is an important aspect of modern life. However, in many instances things go awry in public, commercial, and private home plumbing resulting in temporary reductions in water pressure. This can result in water contamination and illness. Thus there is a significant need for assemblies that reduce the risk to the water supply.

Modern water distribution systems are designed to keep the water flowing to alleviate these risks. However, as a result of deviations from the norm, under certain hydraulic conditions within a water distribution system "normal" flow patterns no longer occur, as a result water flow to the customer can be reversed. When this undesirable reversal of flow happens, contaminated water can enter the distribution system through a cross-connection (a connection between potable water plumbing to a non-potable pipe system). Cross connections are common in swimming pools, sprinkler systems, and fountains. Thus, in such systems it is important to reduce the causes of backflow and to ameliorate the troubles caused by backflow.

Another situation that can cause a risk to a water distribution system is back-siphonage. Back-siphonage is a sudden reduction in the water pressure in the water distribution system, such as during firefighting activities, or when a water main breaks, vigorous water main flushing events, electric power interruption, or distribution system equipment failure. These events may drastically lower distribution system pressure and create a suction effect in the main distribution lines. This can draw a non-potable substance or water that has been contaminated by contact with the environment into the potable water system through a cross connection.

Finally, backpressure is another risk to modern water distribution systems, created when pressure in a non-potable system (as in a re-circulating system containing soap, acid, or antifreeze) exceeds that in the pressure in a connected potable system that provides makeup water to the system. This can force the potable water to reverse its direction of flow through a cross connection. Non-potable substances can then enter the potable water system, contaminating the systems.

As a result of the risk of backflow, many devices exist to prevent it from contaminating the potable water supply. These are generally known as backflow prevention assemblies and include: Air Gap (AG); Double Check Valve Assembly (DC); Reduced Pressure Principal Assembly (RP); Pressure Vacuum Breaker Assembly (PVB); and Spill Resistant Pressure Vacuum Breaker (SVB). One difficulty in such systems is that they require a relief valve for expelling contaminated or potentially contaminated water, as well as for pressure relief. Many such systems today have extremely low flow and thus are not capable of reducing pressure quickly and conveniently. The need for innovative solutions to backflow is shown below.

U.S. Pat. No. 3,996,962, issued to Sutherland, describes a backflow prevention assembly designed for connection between a main supply line and a service pipe in water supply service, comprising two check valves in series and a relief valve for draining the chamber between the two check valves under certain operating conditions.

U.S. Pat. No. 4,893,654, issued to Feuz describes a backflow preventer assembly for a liquid supply line includes a single unitary valve body including flanged inlet and outlet end openings and a single access opening generally normal to the flow path defined by the inlet and outlet openings. The body houses a pair of check valve seats on opposite sides of the access opening for seating a pair of check valves mounted in series to permit flow from the inlet opening to the outlet openings. Adjustable compression rods interconnecting the two check valves seat the valves against their oppositely facing valve seats. The check valves and compression rods are sized to enable installation and removal of the valves through the access opening. In one embodiment the valve body has a predetermined length for installation in the liquid supply line between a pair of gate valve assemblies, such length being the same as a standard body length for a single check valve assembly. In a second embodiment, the single unitary body incorporates, in addition to check valve assemblies, a pair of gate valve housings one on each of the opposite sides of the gate valve assemblies so that the single valve body can incorporate, as a unit, the complete backflow preventer assembly including gate valves and double check valves.

U.S. Pat. No. 6,021,805, issued to Horne et. al, describes a backflow preventer assembly includes a housing, a first mounting assembly configured for assembling by insertion with a first end of the housing, and a second mounting assembly configured for assembling by insertion with a second end of the housing. The housing and mounting assemblies include through bores in fluid communication. Securing material secures opposed surfaces of the first mounting assembly and the housing, and opposed surfaces of the second mounting assembly and the housing. Plating material is located on the inner surfaces of the housing and mounting assemblies. The plating material forms a wall restricting migration of the securing material into the housing and mounting assembly bores. Ball valves and check valves are attached to the mounting assemblies. The housing wall defines a port providing access to the check valves.

Chinese Patent No. CN202056265 to Wensheng Li et al discloses an internal circulation type backflow assembly for a ball screw, which is assembled in a pre-arranged accommodating hole arranged on the periphery of a screw cap from inside to outside. The backflow assembly is provided with a backflow channel, the two ends of the backflow channel are respectively provided with an arc-shaped curved channel, and the two sides of the backflow channel are respectively provided with an extension arm. A half length of the center line of the arc-shaped curved channels arranged at the two ends of the backflow channel and the arc edge radius of the inner side of the arc-shaped curved channels are 0.9 time to 1.1 times of the diameter of a ball. The center line of the two extension arms aligns with the central point of the arc-shaped curved channels, accordingly the backflow of the ball is smoother, the ball blockage is avoided, and the bump is greatly reduced.

These problems, and others, have been addressed by the improved backflow assemblies and attachments disclosed herein and discussed in greater detail below.

BRIEF SUMMARY

Thus, to solve such problems and others, an invention is proposed for use while repairing or servicing backflow assemblies. This novel apparatus will allow for larger openings when flushing a backflow assembly resulting in a higher volume of flushing, which may be necessary for moving of heavy particulate out of a backflow assembly in a controlled manner.

This improved access lid and flushing assembly provides for high flow and greater particulate removal by utilizing large access points previously unavailable. It also utilized a valve and hose so that when flushing the system water and particulates do not shoot out in an uncontrolled manner. This allows a user to use the improved assembly with a bucket, or simply to direct the water and particulate rushing out of the assembly to a desired area.

The advantages of such an application become clear when one is experienced with backflow assemblies and the difficulties of servicing them. Typical devices currently on the market do not have the confluence and plethora of features contemplated and described herein.

In a first embodiment the disclosure contemplates an improved backflow assembly apparatus having: a backflow assembly, the backflow assembly having a body, an inlet, a first valve control assembly connecting the inlet to the body, an outlet, and a second valve control assembly connecting the outlet to the body; and a flushing system connected to the body of the backflow assembly, the flushing system having an access lid for connecting directly to the body, a relief valve connected to the access lid, and a flushing hose attached to the relief valve.

In another embodiment the disclosure contemplates a flushing apparatus having: an access lid with a wide-mouthed lid opening; a relief valve with a valve control, the relief valve connected to the access lid by a threaded relief connection; and a flushing hose connected to the relief valve at a threaded male-female attachment point.

In another embodiment the disclosure contemplates a method for flushing a backflow assembly having: providing a backflow assembling having a body, an inlet, a first valve control assembly connecting the inlet to the body, an outlet, and a second valve control assembly connecting the outlet to the body; connecting a flushing assembly to the backflow assembly, the flushing assembly having an access lid for connecting directly to the body, the access lid having a wide-mouth opening, a relief valve connected to the access lid, and a flushing hose attached to the relief valve; closing the second valve assembly; and flushing water through the flushing assembly thereby flushing the backflow assembly.

Such embodiments do not represent the full scope of the invention. Reference is made therefore to the claims herein for interpreting the full scope of the invention. Other objects of the present invention, as well as particular features, elements, and advantages thereof, will be elucidated or become apparent from, the following description and the accompanying drawing figures.

DESCRIPTION OF THE DRAWINGS

The present invention may be better understood, and its numerous objects, features, and advantages made apparent to those skilled in the art by referencing the accompanying drawings.

FIG. 4(*b*) is a perspective view of a valve release assembly for attachment to the backflow assembly according to the present invention.

DETAILED DESCRIPTION

Referring now the drawings with more specificity, the present invention essentially provides an improved backflow assembly and attachments thereof. The preferred embodiments of the present invention will now be described with reference to FIGS. 1-4 of the drawings. Variations and embodiments contained herein will become apparent in light of the following descriptions.

Figure 1:
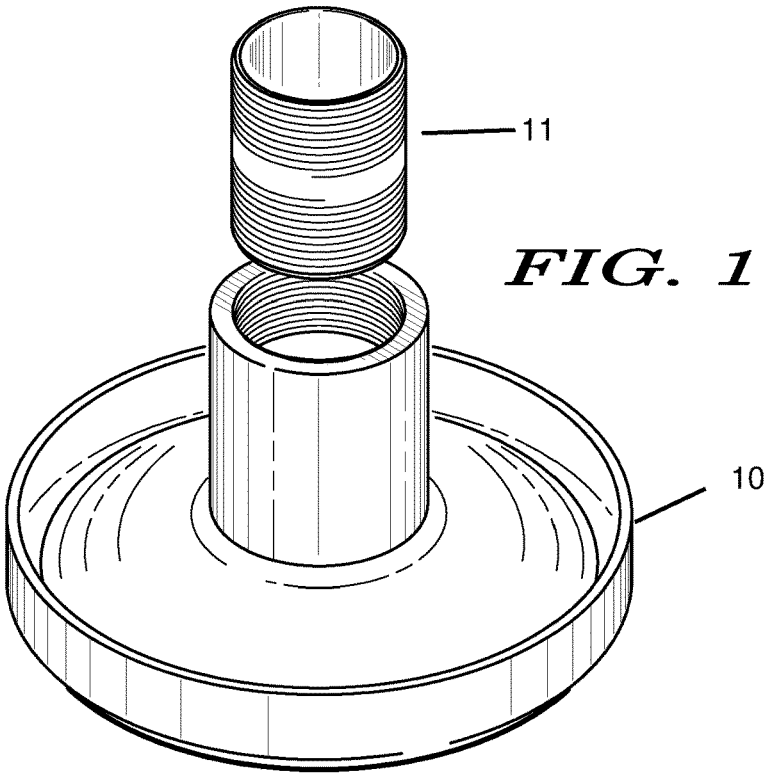
FIG. 1 is a perspective view of a valve lid according to the present invention.
Figure 3:
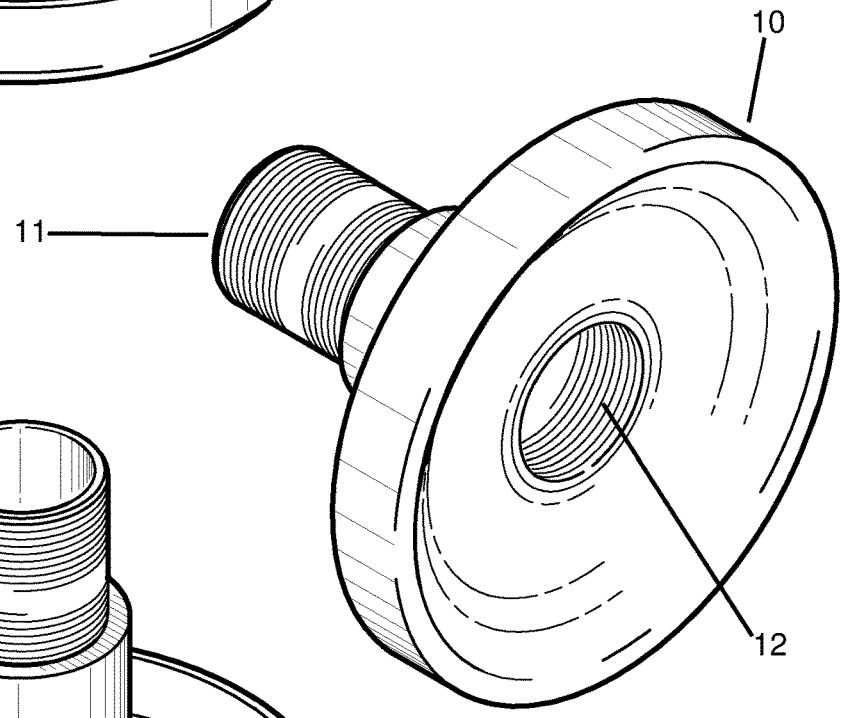
FIG. 3 is a bottom view of the valve lid of FIG. 2.
Figure 2:
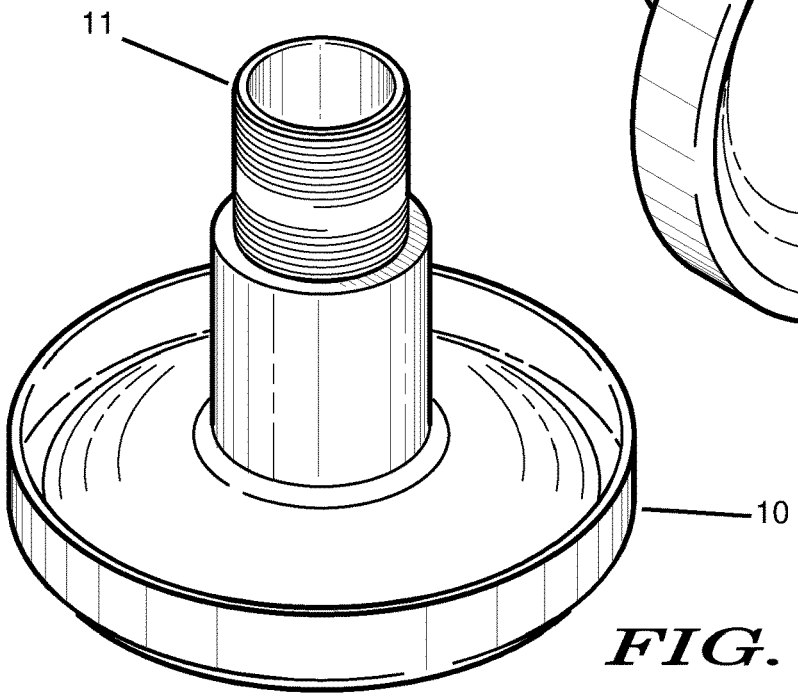
FIG. 2 is a perspective view of the lid according to the present invention in a second configuration.

Looking now to FIGS. 1-3 an improved access lid 10 and threaded relief connection 11 are shown. One unique aspect of the invention is that opening 12, in which relief connection 11 connects can be extraordinarily large for use in flushing applications for the removal of silt and debris. Typical openings are limited to small, ⅛" (one eighth inch) openings which have limited flow capabilities. Utilizing this new design the diameter of opening 12 can be greatly expanded allowing for much larger diameters when connecting to backflow assemblies for flushing larger volumes of water. Ideally, the diameter 12 of the opening will match the diameter of the inflow and outflow to a larger assembly, thus the maximum flow out of the access lid 10 will not be less than the flow into the assembly. Using this new design, the openings for flushing various apparatuses can be as large as a firehose (typically larger than 5"), but also is adapted for controlled flushing at diameters previously unheard of in previous backflow assembly applications such as ½", ¾", 1" and 2" diameters, as further discussed below.

Figures 4A, 4B:
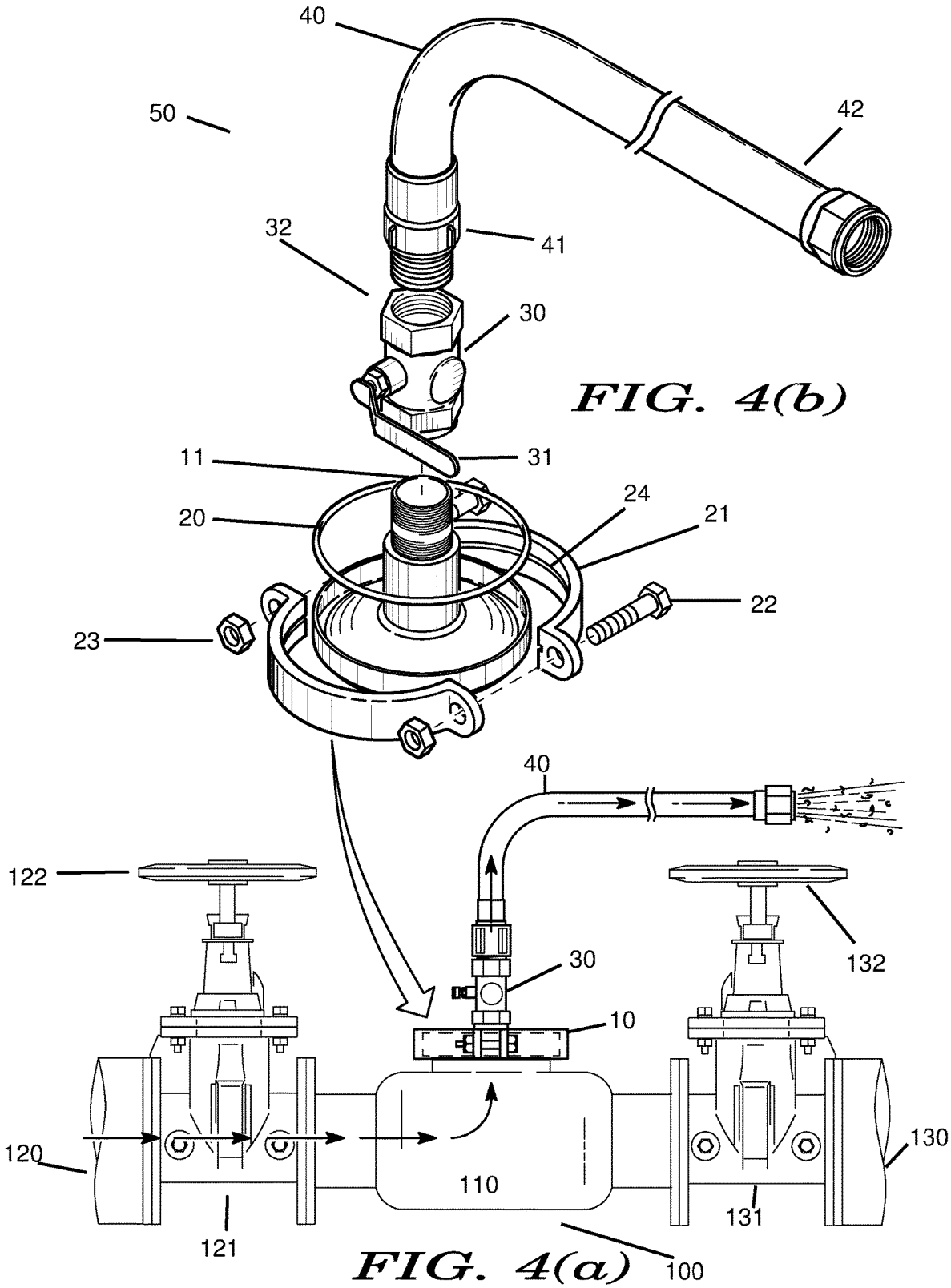
FIG. 4(*a*) is a side view of a backflow assembly according to the present invention.

FIG. 4(*a*) shows an exemplary backflow assembly apparatus 100 including improved access lid 10. In this improved assembly, access lid 10 is attached to the main body 110 of the backflow assembly 100. Attached to lid 10 is relief valve 30 and flushing hose 40 which allow for a controlled flushing of the assembly 100 at high flow and pressure. As assembly 100 is an exemplary backflow assembly, other orientations may be considered for use with improved lid 10. In this orientation, water typically flows through inlet 120 and through the first valve assembly 121 which is selectively controlled by valve control 122 (to adjust pressure and flow). Water then passes into the body 110 and then, in typical operation into the 2nd valve assembly 131 (controlled by control 132), and passes through the outlet 130. However, after certain conditions (discussed above and below) the assembly 100 can become contaminated with debris. In such situations, valve 30 can be opened to flush water out of the body 110 through hose 40 (as shown by arrows in FIG. 4(*a*).

FIG. 4(*b*) shows a more detailed view of the improved flushing system 50 that is attached to backflow assembly 100. Previously shown access lid 10 is secured to the body 110 of assembly 100 using clamps 21. The clamps 21 preferably contain a groove 34 adapted to receive an o-ring 20, and a preferably fastened and tightened using a bolt 22 and nut 23 system. While the nut-and-bolt system is currently shown, there are other methods for tightening clamps 21 and such methods are contemplated herein. As shown previously threaded relief connection 11 is mounted on top of access lid 10 in the lid opening 12, here it is shown connecting lid 10 to relief valve 30. Valve 30 preferably has a control 31 and a threaded attachment 32 for attaching further controlling mechanisms. In the shown embodiment attachment 32 is a threaded female attachment 32. Attachment 32 connects the relief valve 30 to a flushing hose 40 in this embodiment. As shown, hose 40 also has a male attachment 41 and a female attachment 42. This can aid in the portability of the hose as it need not be permanently attached which can cause a stress on the backflow assembly 100 through additional weight.

INDUSTRIAL APPLICABILITY

Improved access lid 10 and improved flushing assembly 50 are intended for use with various backflow assemblies currently on the market. Examples of such assemblies that can be improved by the addition of such flushing include Air Gap, Double Check Valve Assembly; Reduced Pressure Principal Assembly; Pressure Vacuum Breaker Assembly; and Spill Resistant Pressure Vacuum Breaker. Typically, due to pressure and durability concerns these systems, and thus access lid 10 are primarily constructed with corrosion-resistant metals such as steel or stainless steel. Other materials are contemplated such as polyvinyl chloride (PVC), aluminum, or other materials typically used in plumbing applications. Hose 40 should typically be constructed using a flexible material such as rubber or other typical hose material. Valve 30 may preferably be a ball valve (as shown) or may be another type of valve capable of throttling water flow as desired during operation.

An exemplary backflow reduced pressure assembly that may be used with lid 10 and assembly 50 is the Series 4000SS reduced pressure zone assemblies. This assembly and those similar, are designed to provide protection of the potable water supply in accordance with national codes. This series can be used where approved by the local authority having jurisdiction on health-hazard cross-connections. The invention described herein is matable with such devices for providing effective and high-flow flushing of the assembly after a failure of the water supply system that may have resulted in contamination.

Accordingly, although the invention has been described by reference to certain preferred and alternative embodiments, it is not intended that the novel arrangements be limited thereby, but that modifications thereof are intended to be included as falling within the broad scope and spirit of the foregoing disclosures and the appended drawings.

I claim:

1. A backflow assembly apparatus comprising:

a backflow assembly, the backflow assembly having a body, an inlet, a first valve control assembly connecting the inlet to the body, an outlet, and a second valve control assembly connecting the outlet to the body; and a flushing system connected to the body of the backflow assembly, the flushing system having an access lid for connecting directly to the body, a relief valve connected to the access lid, and a flushing hose attached to the relief valve.

2. The backflow assembly apparatus of claim 1 wherein:

the access lid comprises a lid opening and a threaded relief connection the relief connection connecting to the relief valve.

3. The backflow assembly apparatus of claim 2 wherein:

the access lid is connected to the body of the backflow assembly by clamps, the clamps having an o-ring groove, in which an o-ring is situated for preventing water loss at the connection between the body and the access lid.

4. The backflow assembly apparatus of claim 3 wherein:

the clamps are secured to the access lid and tightened using at least two nuts and bolts.

5. The backflow assembly apparatus of claim 3 wherein:

the relief valve further has a valve control and is connected to the threaded relief connection, and further having a threaded female attachment opposite the access lid;

the female attachment connecting to the flushing hose via a male attachment.

6. The backflow assembly apparatus of claim 5 wherein:

the flushing hose further having a female connector opposite the relief valve, and the relief valve being a ball valve adjustable with the valve control.

7. The backflow assembly apparatus of claim 6 further comprising:

a first valve control attached to a first valve assembly; and a second valve control attached to a second valve assembly.

8. The backflow assembly apparatus of claim 6 wherein:

the lid's lid opening has a diameter at least as large as the diameter of inlet and the diameter of the outlet.

9. A flushing apparatus comprising:

an access lid with a lid opening;

a relief valve with a valve control, the relief valve connected to the access lid by a threaded relief connection; and a flushing hose connected to the relief valve at a threaded male-female attachment point.

10. The flushing apparatus of claim 9 further comprising:

a clamping apparatus for attaching the access lid to a backflow assembly, the clamping apparatus comprising two clamps, each having an o-ring groove, an o-ring, and an apparatus for tightening the clamps around the access lid.

11. The flushing apparatus of claim 10 wherein:

the lid opening is at least 2" (inches) in diameter.

12. The flushing apparatus of claim 10 wherein:

the flushing hose further having a female connector opposite the relief valve, and the relief valve being a ball valve adjustable with the valve control.

13. A method for flushing a backflow assembly comprising:

providing a backflow assembling having a body, an inlet, a first valve control assembly connecting the inlet to the body, an outlet, and a second valve control assembly connecting the outlet to the body;

connecting a flushing assembly to the backflow assembly, the flushing assembly having an access lid for connecting directly to the body, the access lid having an opening, a relief valve connected to the access lid, and a flushing hose attached to the relief valve;

closing the second valve assembly; and flushing water through the flushing assembly thereby flushing the backflow assembly.

14. The method of claim 13 wherein:

the opening has a diameter of at least as large as the diameter of the inlet.

15. The method of claim 13 wherein:

the opening has a diameter of at least 2" (inches).

16. The method of claim 14 wherein:

the relief valve has a valve control and is connected to the access lid by a threaded connection.

17. The method of claim 16 wherein:

the access lid is connected to the body of the backflow assembly by clamps, said clamps having an o-ring groove in which an o-ring can be situated for reducing spillage at the connection point.

* * * * *